US011015896B1

(12) United States Patent
Hochberg

(10) Patent No.: US 11,015,896 B1
(45) Date of Patent: May 25, 2021

(54) FLYING DISC LAUNCHER

(71) Applicant: Franklin Sports, Inc., Stoughton, MA (US)

(72) Inventor: Seth Hochberg, Walpole, MA (US)

(73) Assignee: Franklin Sports, Inc., Stoughton, MA (US)

( * ) Notice: Subject to any disclaimer, the term of this patent is extended or adjusted under 35 U.S.C. 154(b) by 0 days.

(21) Appl. No.: 17/079,353

(22) Filed: Oct. 23, 2020

(51) Int. Cl.
*F41B 4/00* (2006.01)
*A63B 69/40* (2006.01)
*F41J 9/18* (2006.01)

(52) U.S. Cl.
CPC ..... *F41B 4/00* (2013.01); *A63B 69/406* (2013.01); *A63B 2069/402* (2013.01)

(58) Field of Classification Search
CPC ..... F41B 4/00; F41B 7/08; F41J 9/18; A63B 69/406; A63B 2069/402
USPC ..... 124/6, 8, 78, 81
See application file for complete search history.

(56) References Cited

U.S. PATENT DOCUMENTS 3,717,136 A * 2/1973 Gay et al. ..... A63H 27/14 124/21
5,050,575 A * 9/1991 Killion ..... F41B 7/08 124/8
5,396,876 A * 3/1995 Liscio ..... A63B 69/0024 124/34
5,471,967 A * 12/1995 Matsuzaki ..... F41B 4/00 124/6
5,720,664 A * 2/1998 Brubacher ..... F41A 33/02 124/8
5,782,228 A * 7/1998 Wu ..... F41B 4/00 124/6
5,857,451 A * 1/1999 Ciluffo ..... A63B 69/0026 124/6
5,947,101 A * 9/1999 Kerr ..... F41B 4/00 124/78
5,996,564 A * 12/1999 Kotowski ..... F41B 4/00 124/6
6,116,229 A * 9/2000 Wu ..... F41B 4/00 124/6
7,051,727 B2 * 5/2006 Wu ..... F41B 4/00 124/6
8,899,216 B2 * 12/2014 Laporte ..... F41J 9/24 124/6
9,052,169 B2 * 6/2015 Laporte ..... F41J 9/24
9,057,589 B2 * 6/2015 Laporte ..... F41J 9/18
9,086,257 B2 * 7/2015 Laporte ..... A63B 69/40
9,914,041 B2 * 3/2018 Vorozilchak ..... A63B 69/406

* cited by examiner

*Primary Examiner* — Alexander R Niconovich
(74) *Attorney, Agent, or Firm* — Joseph B. Bowman

(57) ABSTRACT

A wheel-driven flying disc launcher for conventionally sized and weighted flying discs to achieve optimal velocity, lift and angular momentum for sustained flight. Flying discs having a diameter in the range of 15 cm to 28 cm and a weight in the range of 60 gm to 120 gm engage a spinning drive wheel having a diameter in the range of 10 to 25 cm for discharge through an annulus chute having a width substantially equal to the diameter of the flying disc to be launched and extending through an angle θ around the center of the drive wheel in the range of 45 to 80 degrees.

17 Claims, 18 Drawing Sheets

FLYING DISC LAUNCHER

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a flying disc launcher. More specifically, this invention relates to a mechanical launcher to accurately discharge a conventional flying disc for optimal aerodynamics.

Flying discs, sometimes referenced under the trademark FRISBEE, have long been popular in various sport and recreational activities. Outdoor games such as Ultimate and Disc Golf have developed as competitive sports with many players becoming expert throwers of flying discs for both distance and target accuracy. Of course, many dog-lovers have enjoyed throwing a flying disc for active and agile dog breeds. And flying discs are frequently seen at parks and playgrounds with a couple sailing a flying disc back and forth to each other.

Conventional flying discs are normally formed of molded plastic in a slightly domed, circular shape having a diameter between 20 and 28 cm with a pronounced peripheral lip. Typically, a flying disc can range in weight from 140 to 200 gm.

A flying disc is a modified airfoil, so the aerodynamics are determined to some extent by Bernoulli's Theorem. When it is thrown, because of the domed shape of the flying disc, air moves over the top surface faster than it moves over the bottom surface. In accordance with Bernoulli's Theorem, the faster moving air causes a lower pressure, so the flying disc experiences the force of lift applied at the center of the flying disc. Drag is a resistant force on the flying disc, perpendicular to the lift, and it acts against the disc's movement through the air. The angle at which the flying disc is thrown (i.e., the "launch angle") affects both lift and drag.

A second important factor affects the aerodynamics of a flying disc. It is angular momentum. When properly thrown, a user attempts to impart with a flick of the wrist spin to the flying disc. The spinning of the flying disc imparts a gyroscopic effect which stabilizes flight of the disc. Conventional wisdom suggests that the greater the angular velocity, therefore, yields greater stability of flight.

For those less athletically inclined with difficulty in delivering a flying disc by hand, mechanical launchers have been developed in the past. These basically fall into two categories—those using a spring force to launch the flying disc and those using a spinning wheel to launch the flying disc.

Prior art U.S. Pat. Nos. 3,717,136 and 5,050,575 both relate to spring force types of launchers. U.S. Pat. No. 3,717,136 has a spring-loaded launch lever that propels the flying disc through a straight discharge chute. The launch lever has a corrugated surface which mates with corrugations on the peripheral lip of the specially formed flying disc to impart angular spin as the flying disc travels through the discharge chute. U.S. Pat. No. 5,050,575 also has a spring-loaded launch lever that captures the flying disc and biases the disc against a curvilinear wall with a gripping surface to impart angular spin to the flying disc before being launched from the device.

Prior art U.S. Pat. Nos. 5,471,967, 5,782,228, 5,996,564, and U.S. Pat. No. 6,116,229 all relate to launchers having a spinning wheel to engage the flying disc and propel it from the device through a straight discharge chute. In U.S. Pat. No. 5,471,967, the spinning wheel lies in the same plane as the flying disc and only momentarily contacts the flying disc to deliver it to a straight discharge chute and out of the launcher. Such arrangement imparts some forward force and some angular velocity to the flying disc but fails to develop the full aerodynamic capabilities of a flying disc delivered with sufficient force and angular momentum for stable flight. U.S. Pat. Nos. 5,782,228, 5,996,564, and U.S. Pat. No. 6,116,229 all provide handheld toy products wherein a small spinning wheel is oriented perpendicular to the plane of the flying disc to deliver it to a straight discharge chute and out of the product. Again, such prior art developments certainly have their place in the toy market, but they fail to develop the full aerodynamic capabilities of a flying disc delivered with sufficient force and angular momentum for stable flight over distance.

The need therefore remains in the field of mechanical flying disc launchers for a wheel-driven launcher to accurately discharge a conventional flying disc for optimal aerodynamic characteristics.

SUMMARY OF THE INVENTION

More specifically, an object of the invention is to provide a wheel-driven flying disc launcher for conventionally sized and weighted flying discs to achieve optimal velocity, lift and angular momentum for sustained flight.

Another object of the invention is to provide a wheel-driven flying disc launcher for flying discs ranging in diameter from approximately 15 cm to 28 cm and ranging in weight from approximately 60 gm to 120 gm.

Yet another object of the invention is to provide a wheel-driven flying disc launcher having a variable speed drive wheel for controlling the angular momentum of appropriately sized flying discs for the launcher.

A further object of the invention is to provide a wheel-driven flying disc launcher having a variable speed drive wheel having a diameter in the range of approximately 10 to 25 cm.

An additional object of the invention is to provide a wheel-driven flying disc launcher with a variable speed drive wheel and having an adjacent curvilinear discharge chute with a width approximately equal to the diameter of the flying disc to be discharged from the launcher.

A corollary object of the invention is to provide a wheel-driven flying disc launcher of the character described wherein the discharge chute is an annulus with an inside radius equal to the radius of the drive wheel and the outside radius is approximately equal to the radius of the drive wheel plus the diameter of the flying disc to be discharged from the launcher.

Another object of the invention is to provide a wheel-driven flying disc launcher of the character described wherein the annulus discharge chute extends through an angle around the center of the drive wheel in the range of 45 to 80 degrees.

An added object of the invention is to provide a wheel-driven flying disc launcher of the character described with provisions to vary the launch angle of a flying disc within the range of 0 to approximately 25 degrees.

Another object of the invention is to provide a wheel-driven flying disc launcher of the character described wherein the drive wheel includes a motor powered by disposable batteries, rechargeable batteries, or an AC power source.

Yet another object of the invention is to provide a wheel-driven flying disc launcher of the character described which may be collapsible for storage convenience and packaging.

A further object of the invention is to provide a wheel-driven flying disc launcher of the character described wherein the drive wheel is housed to provide safe operation of the launcher.

In summary, an object of the invention is to provide a wheel-driven flying disc launcher for conventionally sized and weighted flying discs to achieve optimal velocity, lift and angular momentum for sustained flight. Flying discs having a diameter in the range of 15 cm to 28 cm and a weight in the range of 60 gm to 120 gm engage a spinning drive wheel having a diameter in the range of 10 to 25 cm for discharge through an annulus chute having a width substantially equal to the diameter of the flying disc to be launched and extending through an angle θ around the center of the drive wheel in the range of 45 to 80 degrees.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
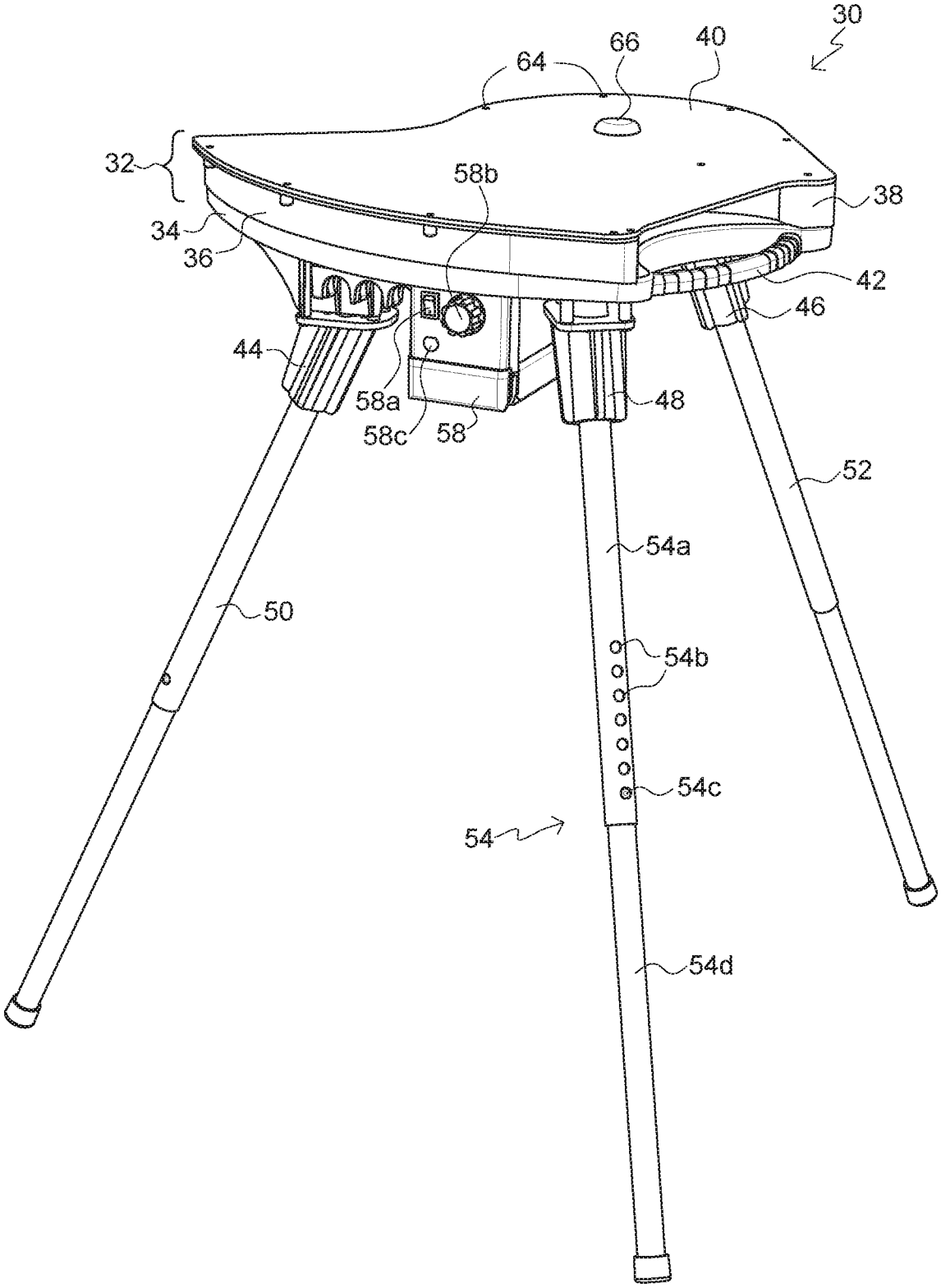
FIG. 1 is a perspective view of a flying disc launcher constructed in accordance with a first embodiment of the invention.
Figure 2:
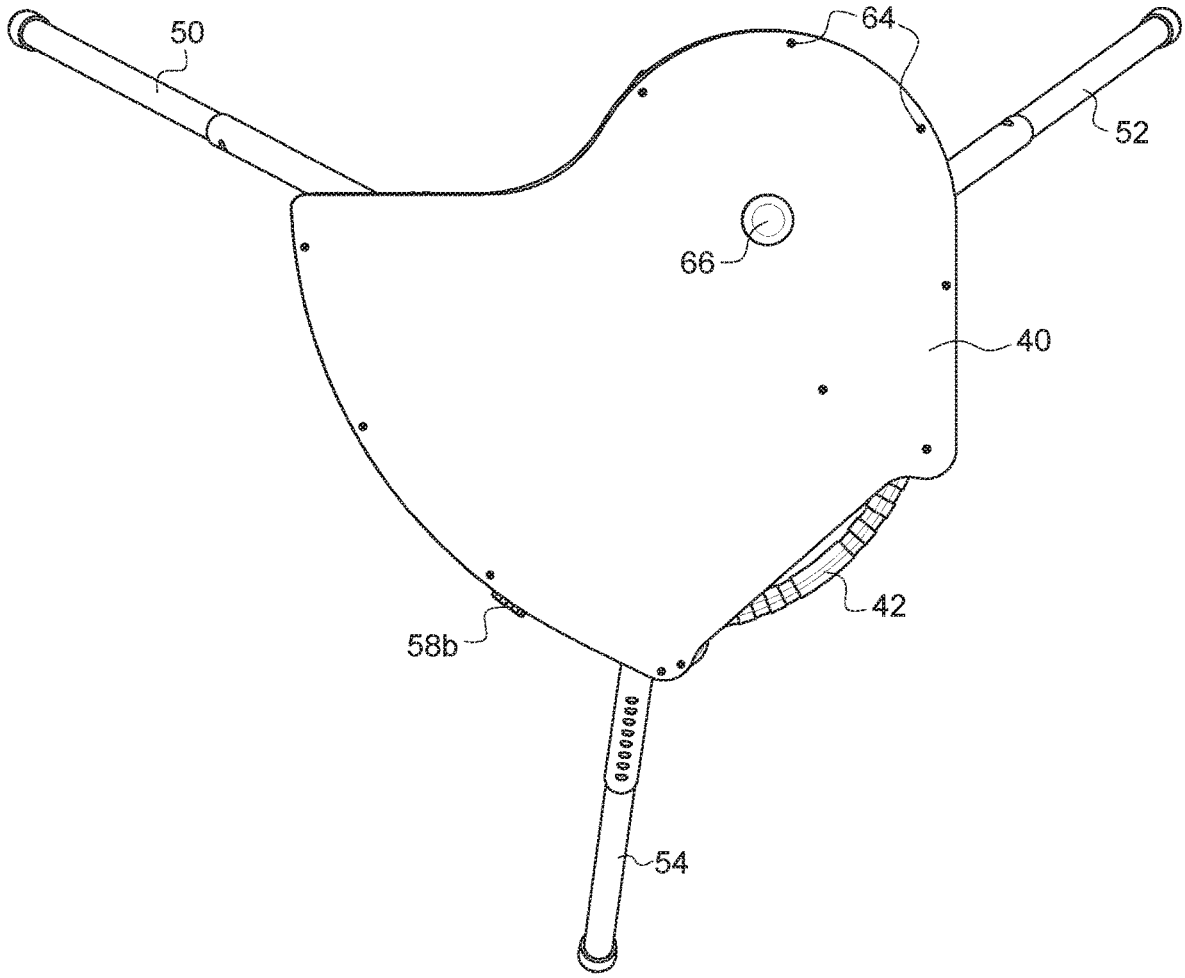
FIG. 2 is a top plan view of the flying disc launcher.

Referring to the invention in greater detail, attention is first directed to FIGS. 1-9 showing a larger sized wheel-driven flying disc launcher generally designated by the numeral 30 for flying discs in the upper ranges of the diameters and weights previously mentioned as being 15 to 28 cm diameter and 60 to 120 gm weight. Preferably for this first embodiment of the invention, the flying disc diameter is in the range of 20 to 28 cm and the weight is in the range of 100 to 120 gm. The launcher 30 includes a housing 32 formed as a base plate 34, side walls 36 & 38, a top cover 40, and a handle 42.

Secured to the lower surface of the base plate 34 are a pair of forward sockets 44 & 46, and a rearmost socket 48. The forward sockets 44 & 46 removably receive telescopic legs 50 & 52, respectively, which can be collapsed to about half of their fully extended length. The rearmost socket 48 removably received a telescopic leg 54 which is adjustable in overall length by means of a series of holes 54*b* in the upper segment 54*a* of leg 54 into which can register with a push-pin 54*c* in the lower segment 54*d* of leg 54. The holes 54*b* are arranged such that the housing 32, and therefore the launch angle, can be adjustably supported at horizontal (i.e., a launch angle of 0 degrees), up to an angle of approximately 15 degrees.

Also secured to the lower surface of the base plate 34 is a variable speed motor & housing 56 operatively connected to a power source & housing 58. The power source may alternatively include disposable DC batteries for a DC motor, rechargeable DC batteries for a DC motor, an AC power connection for an AC motor, or an AC power connection with DC inverter for a DC motor. It is thought that such power alternatives are well-known to those skilled in the arts of powering small motors. Shown on the power source & housing 58, as an example, are on-off switch 58*a*, variable motor speed control knob 58*b*, and rechargeable battery connection 58*c*.

Lastly, and also secured to the lower surface of the base plate 34 are a pair of spaced-apart, leg retention brackets 60 & 62 (see FIGS. 8 & 9) adapted to hold in a storage position the collapsed, telescopic legs 50, 52 & 54.

The top cover 40 is connected to the side walls 36 & 38 by a plurality of spaced apart screws 64. The top cover 40 also includes a bearing 66 for centering the work shaft 68 of the motor 56 as seen in FIGS. 3-5 with the top cover 40 removed to better illustrate the internal details of the housing 32.

Figure 3:
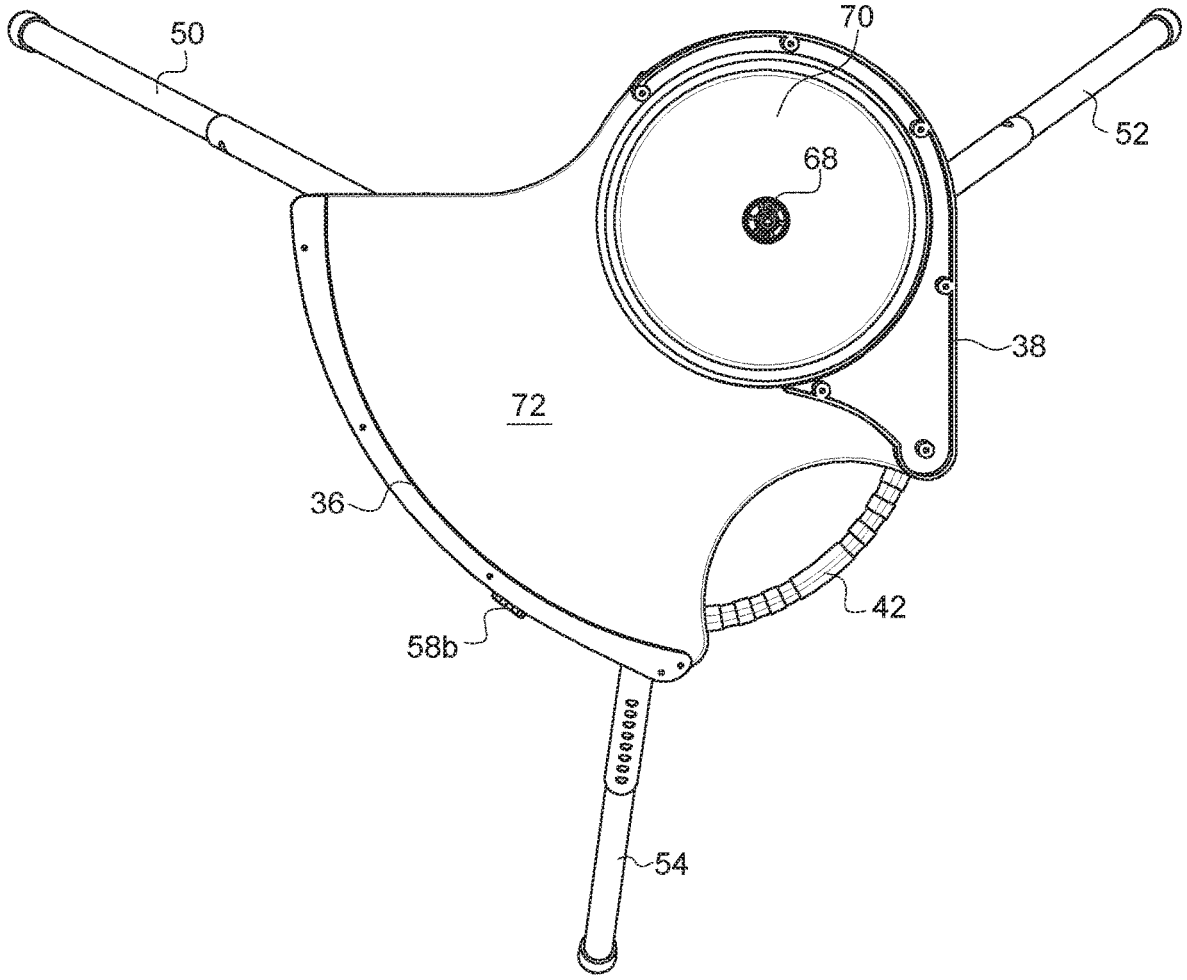
FIG. 3 is a top plan view of the flying disc launcher with the top cover shield removed to show the drive wheel and internal configuration of the disc discharge chute.
Figure 4:
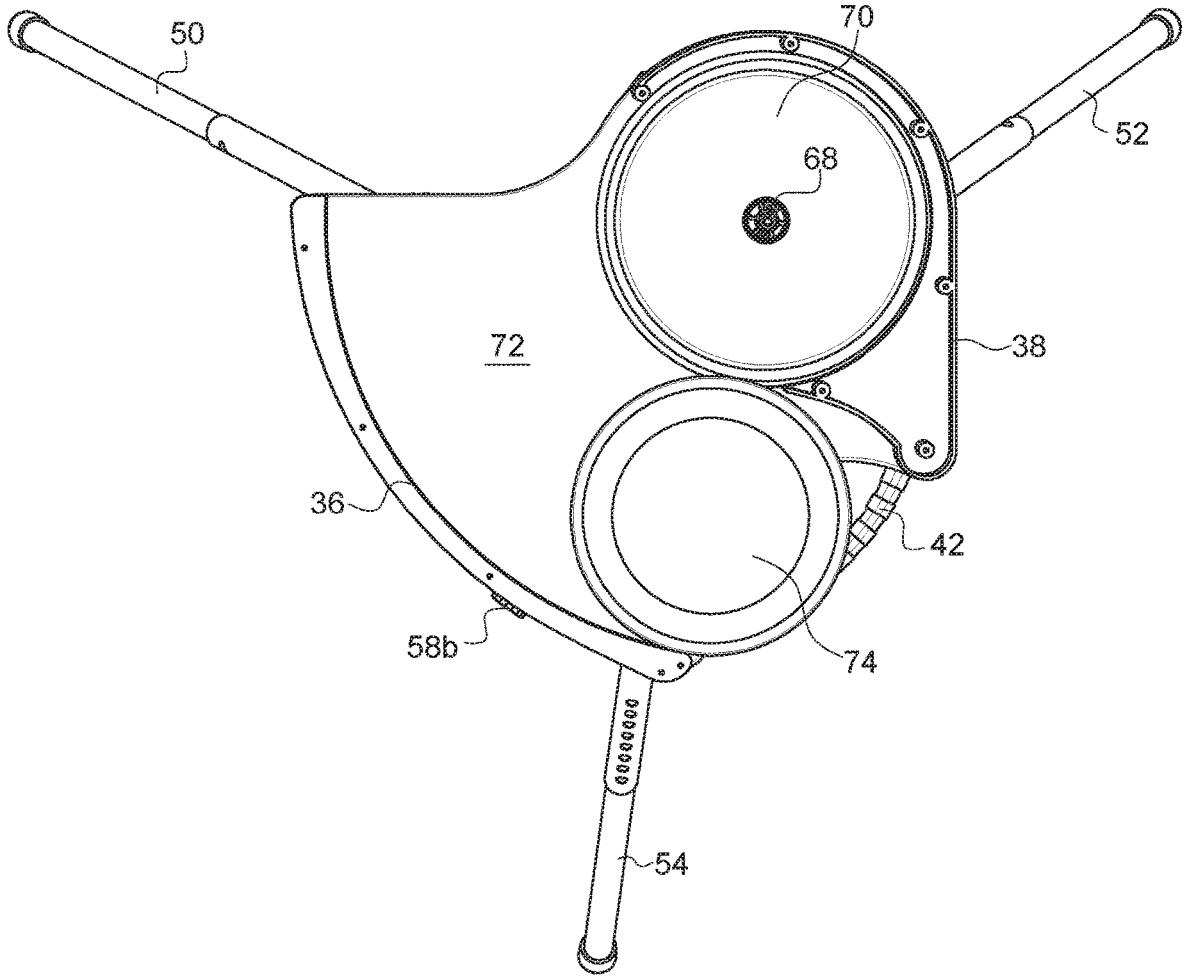
FIG. 4 is a top plan view of the flying disc launcher like that of FIG. 3 but showing a flying disc in a prelaunch position.
Figure 5:
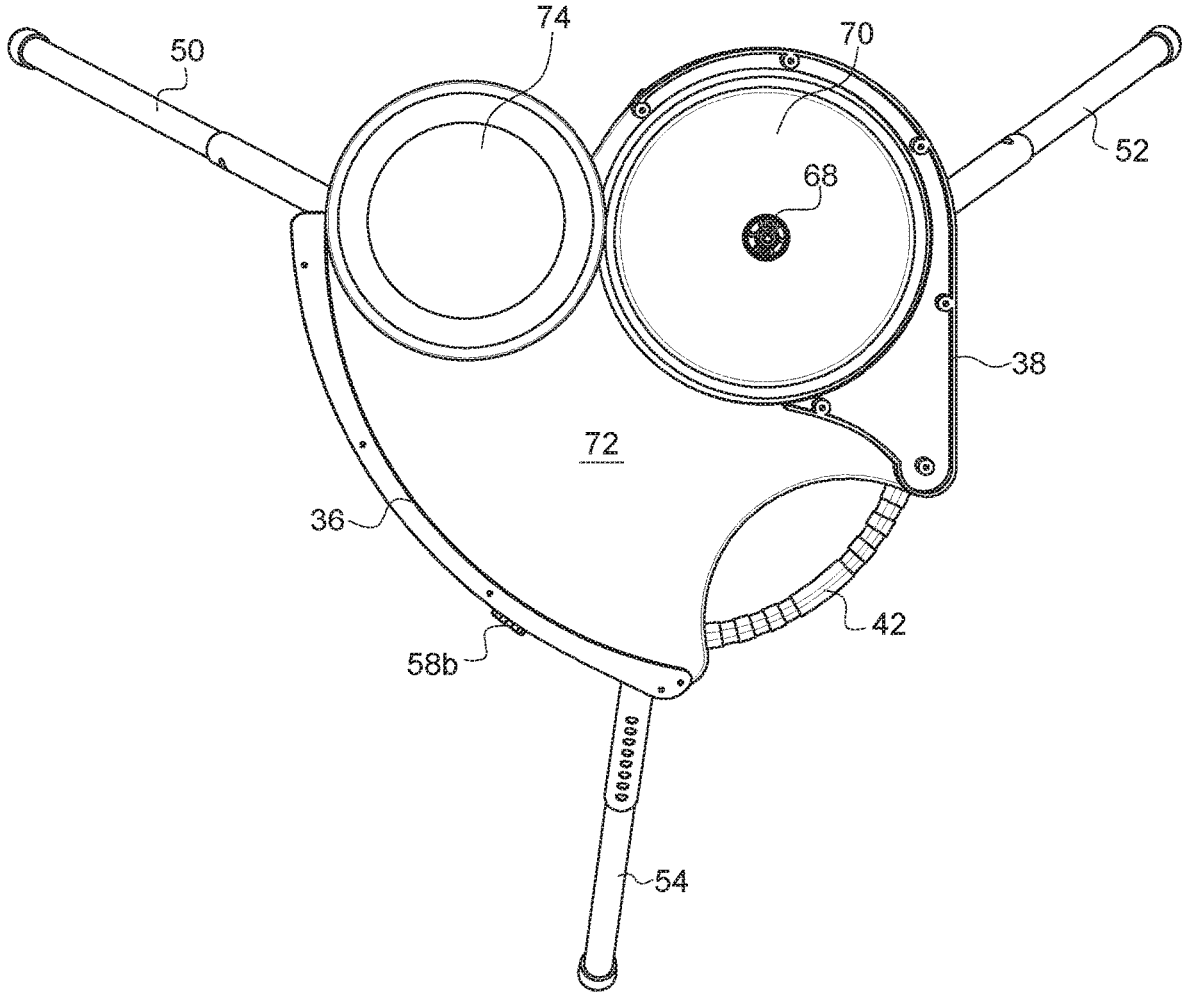
FIG. 5 is a top plan view of the flying disc launcher like that of FIG. 3 but showing a flying disc in a discharge position leaving the launcher.
Figure 6:
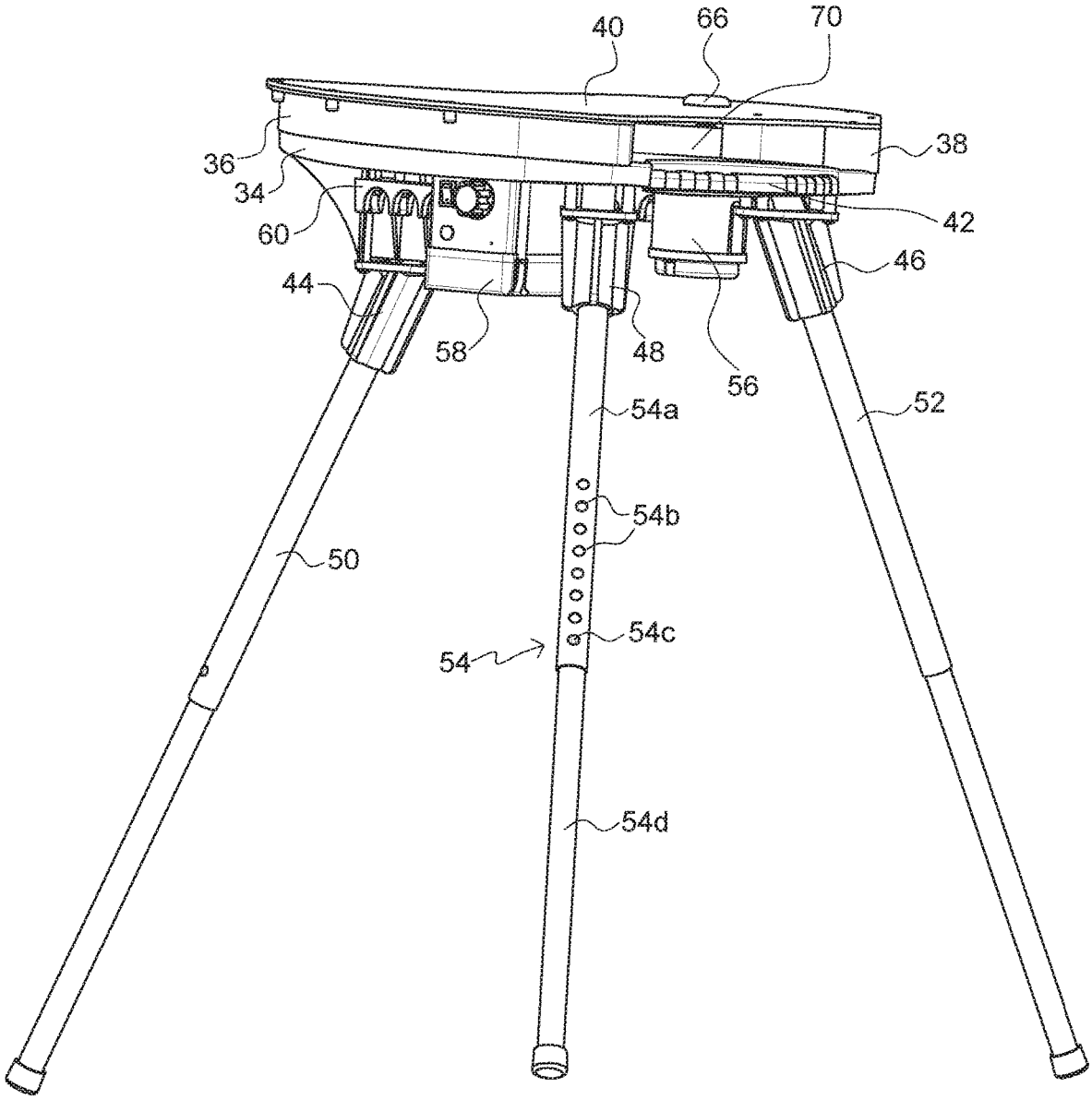
FIG. 6 is a rear elevational view of the flying disc launcher.
Figure 7:
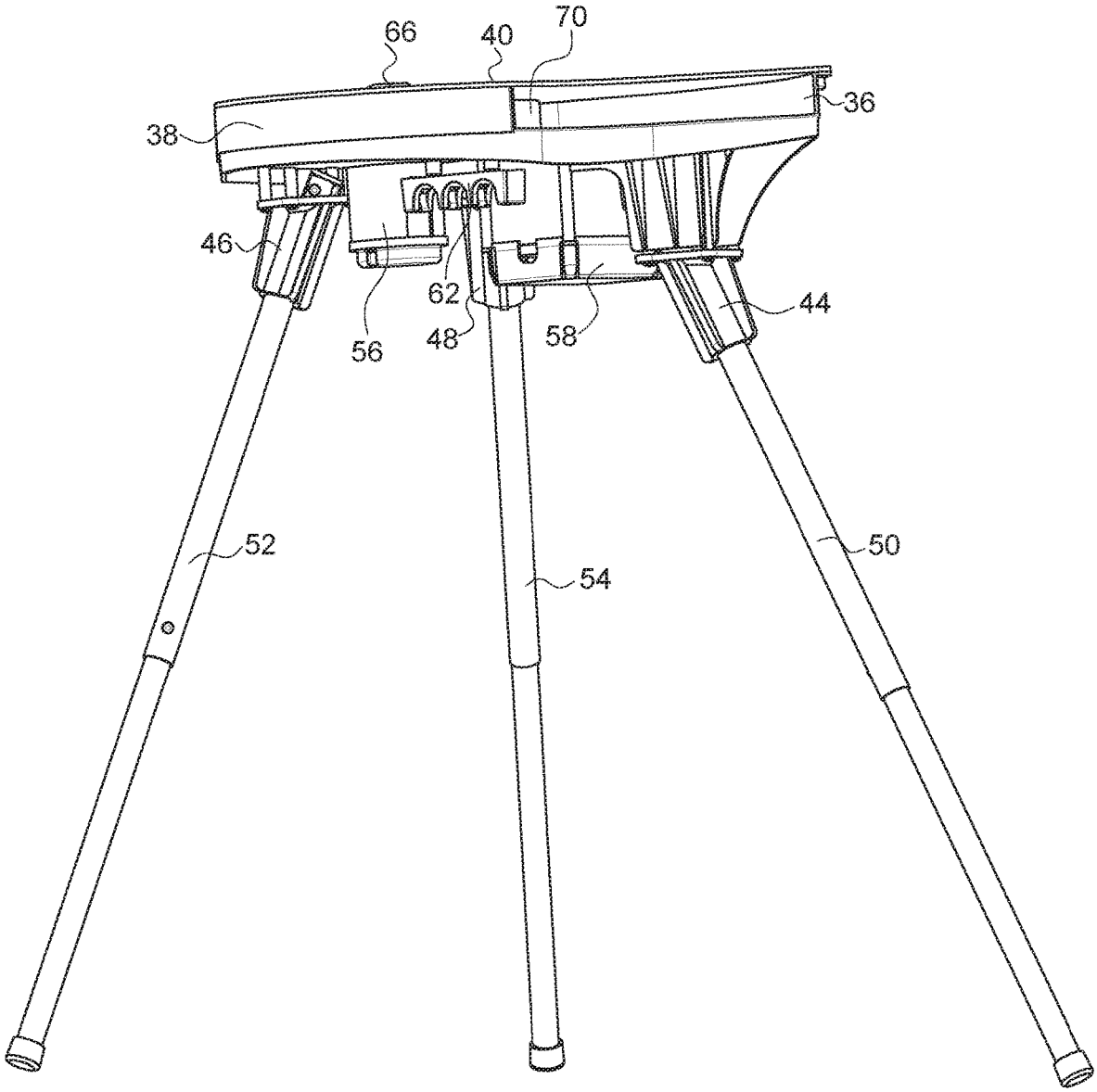
FIG. 7 is a front elevational view of the flying disc launcher.
Figure 8:
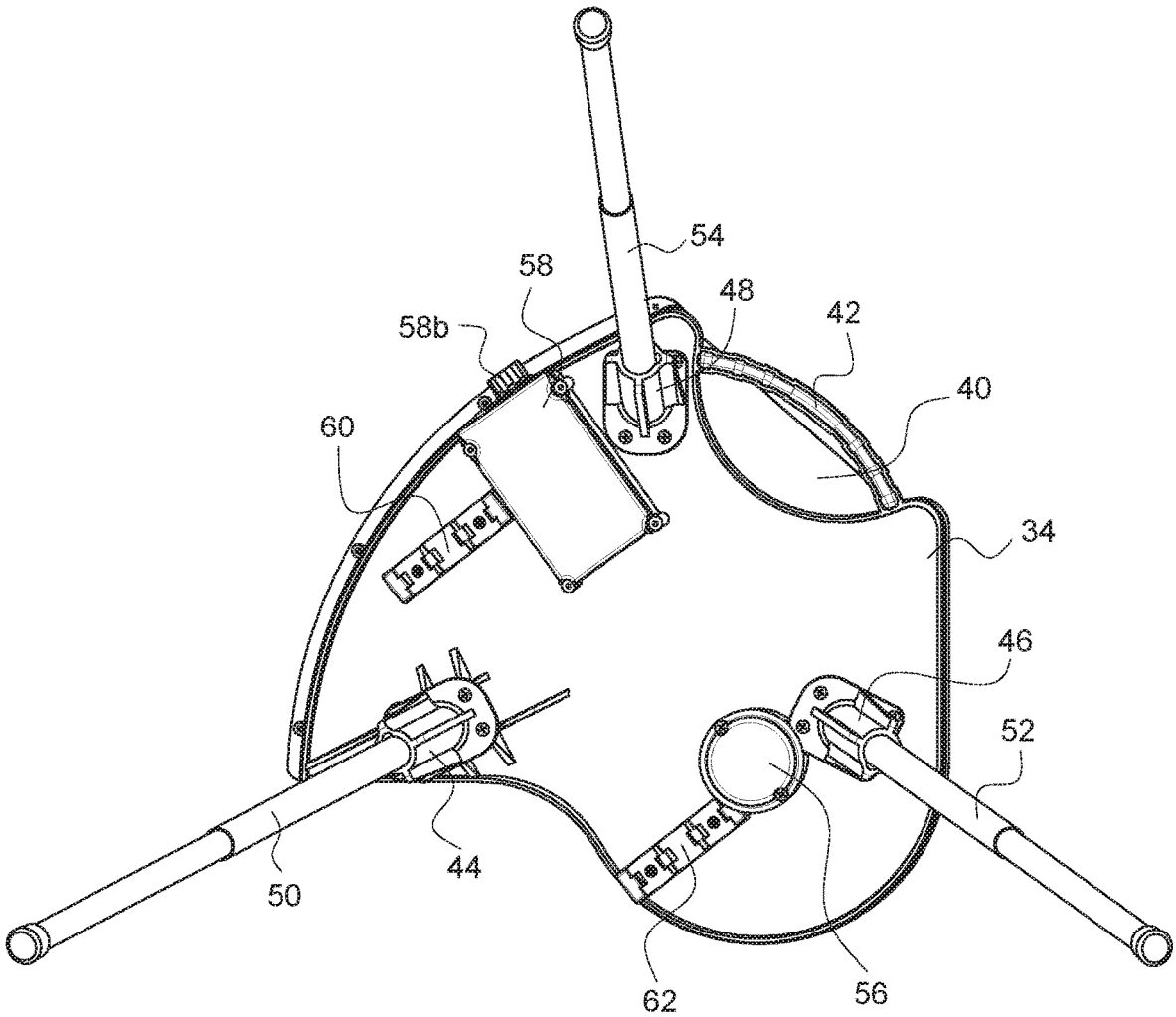
FIG. 8 is a bottom plan view of the flying disc launcher.

Adjacent the side wall 38 and centrally keyed to the work shaft 68 of the motor 56 is a drive wheel 70 adapted to spin in a clockwise rotation as shown in FIGS. 3-5. Side wall 36 is curvilinear and concentric in radius to the axis of the drive wheel 70. The distance between the side wall 36 and the drive wheel 70 on the base place 34 establishes an annulus discharge chute 72 substantially equal to or slightly less than the diameter of the flying disc 74 to be discharged from the launcher 30. FIG. 4 illustrates the position of the flying disc 74 as it initially engages both the side wall 36 and the drive wheel 70 which will cause the flying disc 74 to rotate through the annulus discharge chute 72 in a counter clockwise rotation until it leaves the launcher 30 as shown in FIG. 5. Importantly, the annulus discharge chute 72 extends through an angle θ around the center of the drive wheel 70 in the range of 45 to 80 degrees. For this first embodiment of the invention, however, the angle θ is preferably in the range of 70 to 80 degrees, with the angle θ for FIGS. 3-5 being approximately 78 degrees.

From physics, it is known that the angular momentum (L) of a rotating body is equal to the moment of inertia (I) times the angular velocity in rad/sec (ω). The moment of inertia of a symmetrical body such as a flying disc 74 is equal to ½ times mass (m) times the radius squared ($r^2$). For example, therefore, if the flying disc 74 has a diameter of approximately 22.2 cm and weight of approximately 105 gm, then its moment of inertia is approximately 6480 gm-$cm^2$. Assuming the drive wheel 70 has a diameter of 25.2 cm and rotates between 600 and 3500 rpm, and ignoring any friction loss between the drive wheel 70 and the flying disc 74 as it travels through the angle θ of about 78° in the discharge chute 72, then the theoretical angular momentum of the flying disc 74 would fall in the desirable range of 0.046 to 0.269 kg-$m^2$/sec when discharged from the launcher 30. It is preferable that the angular momentum of the flying disc 74 be greater than 0.20 kg-$m^2$/sec which requires that the speed of the drive wheel 70 be towards the upper range previously indicated.

Figure 9:
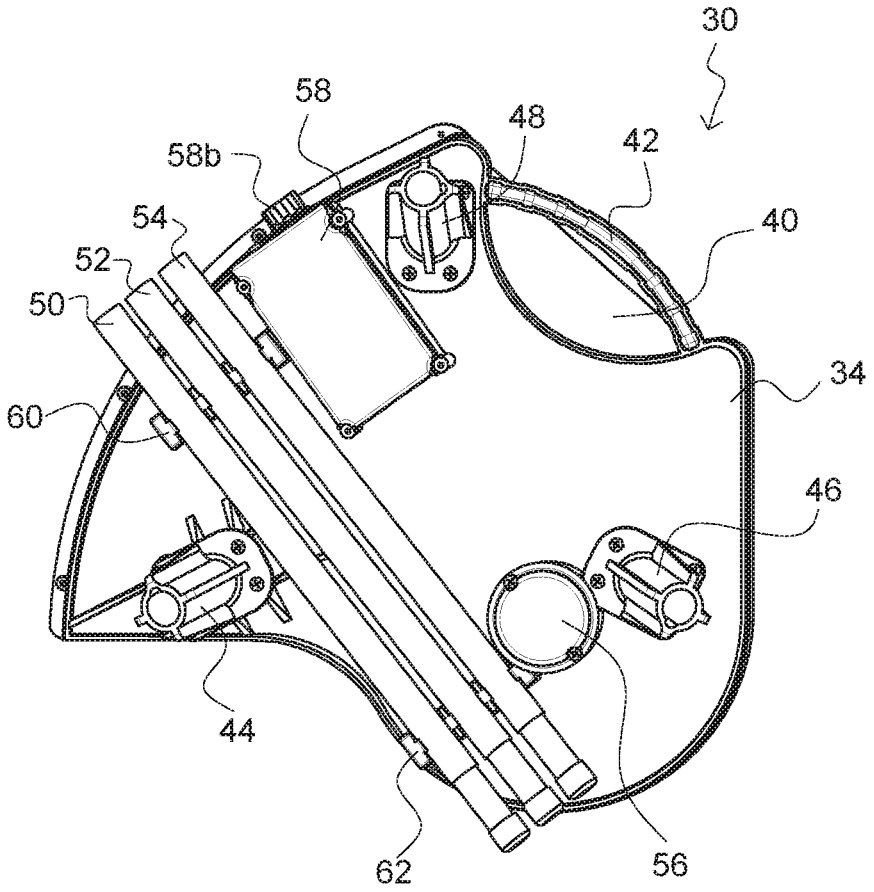
FIG. 9 is a bottom plan view of the flying disc launcher with the support legs collapsed and positioned in brackets for compact storage.
Figure 10:
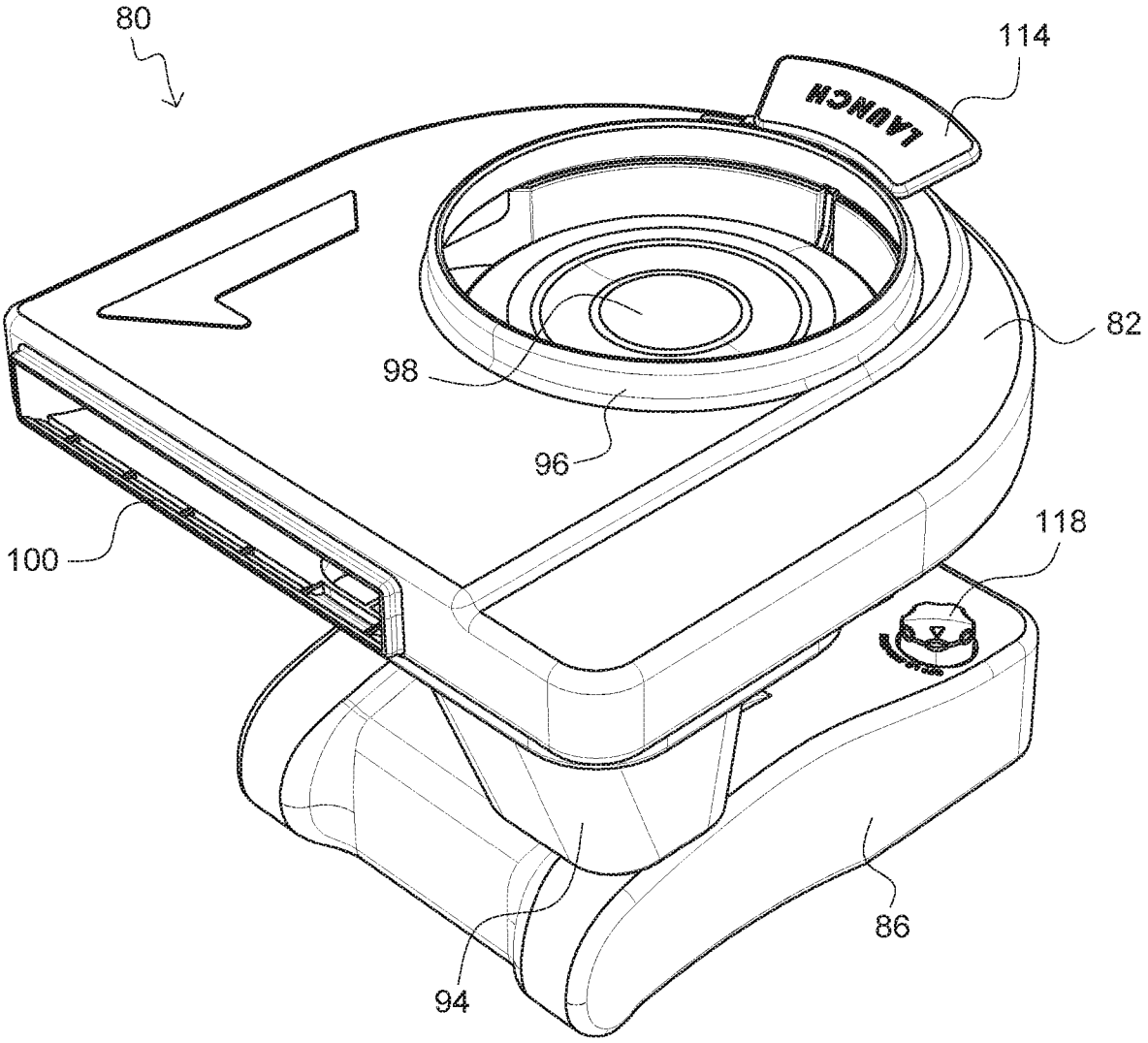
FIG. 10 is a front perspective view of a flying disc launcher constructed in accordance with a second embodiment of the invention.
Figure 11:
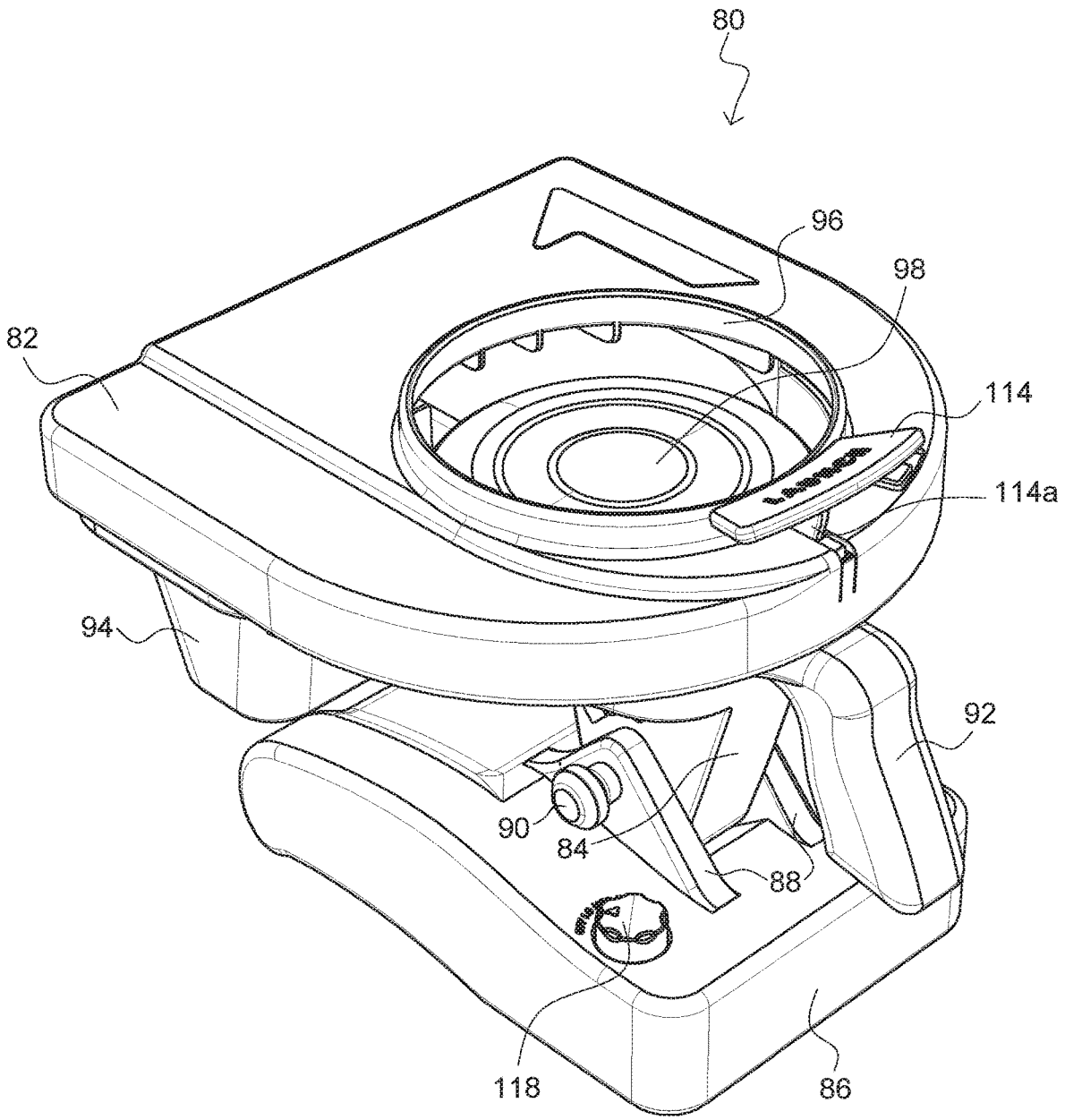
FIG. 11 is a rear perspective view of the flying disc launcher.
Figure 12:
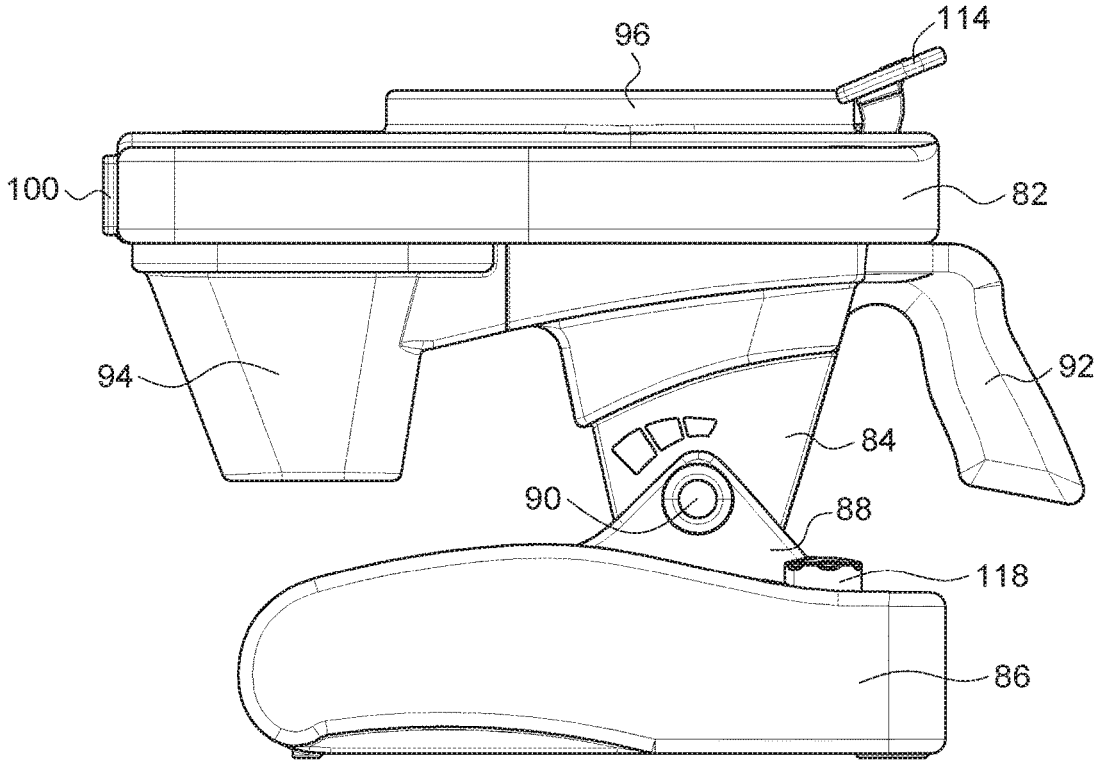
FIG. 12 is a left side elevational view of the flying disc launcher.
Figure 13:
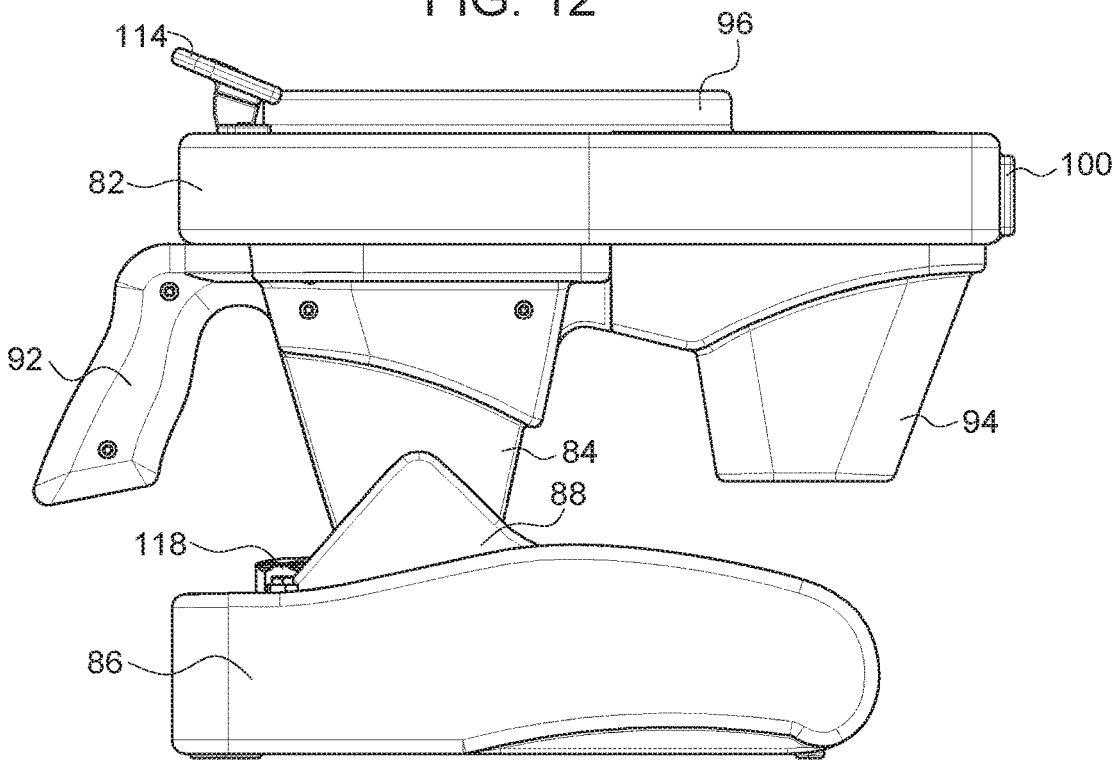
FIG. 13 is a right side elevational view of the flying disc launcher.
Figure 14:
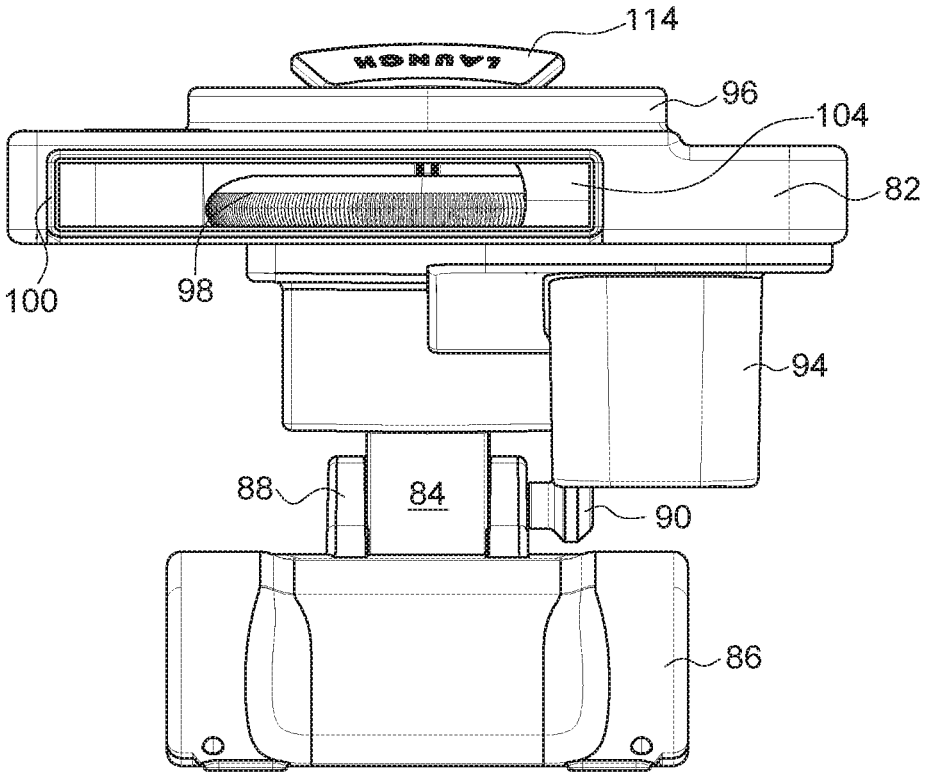
FIG. 14 is a front elevation view of the flying disc launcher.
Figure 15:
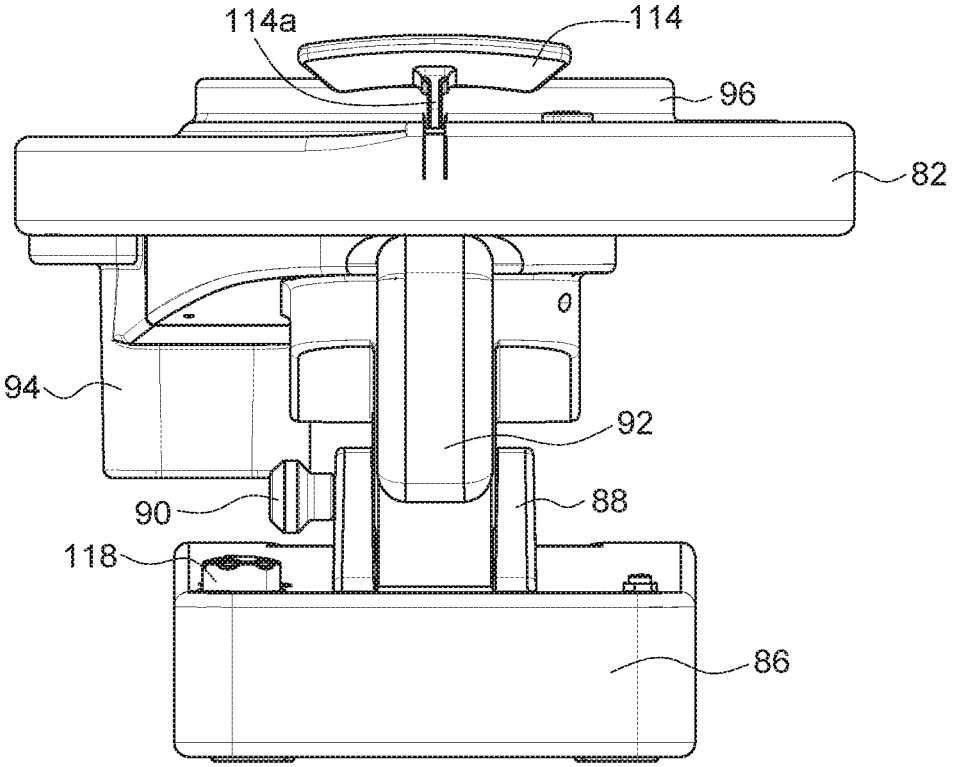
FIG. 15 a rear elevation view of the flying disc launcher.
Figure 16:
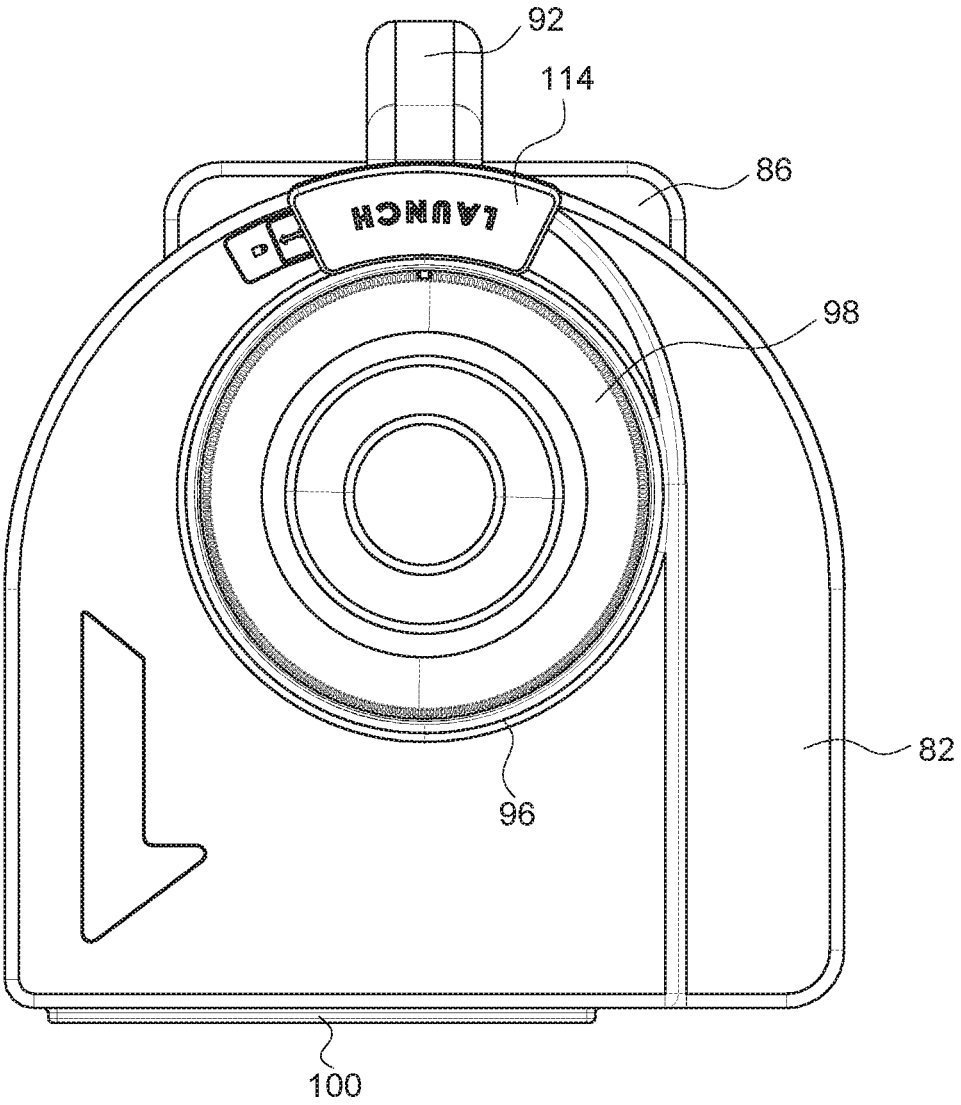
FIG. 16 is a top plan view of the flying disc launcher with a flying disc positioned in a prelaunch chamber.

In operation of the first embodiment of the invention as previously described with reference to FIGS. 1-9, and initially assuming that the launcher 30 is in its storage condition as shown in FIG. 9, the legs 50, 52 & 54 are removed from storage brackets 60 & 62, extended in length, and installed respectively in sockets 44, 46 & 48. The push-pin 54*c* of leg 54 in the rearmost socket 48 may be positioned in one of the holes 54*b* so as to adjust the launch angle from zero (i.e., horizontal) to about 15°. The motor 56 is turned on with switch 58*a* and adjusted to a desired speed with the speed control knob 58*b*. The flying disc 74 may then be inserted into the rear opening of the housing 32. When inserted far enough to engage the spinning drive wheel 70, the flying disc 74 is caused to rotate counter clockwise against the side wall 36 as it travels through angle θ of approximately 78° of the annulus discharge chute 72 and is discharged from the launcher at an angular momentum in the range of 0.046 to 0.269 kg-$m^2$/sec.

Attention is next directed to FIGS. 10-22 and the second embodiment of the invention showing a smaller sized wheel-driven flying disc launcher generally designated by the numeral 80 for flying discs in the lower ranges of the diameters and weights previously mentioned as being 15 to 28 cm diameter and 60 to 120 gm weight. Preferably for this second embodiment of the invention, the flying disc diameter is in the range of 15 to 20 cm and the weight is in the range of 60 to 80 gm.

The launcher 80 includes an upper housing 82 connected by a transition section 84 to a base 86. The base 86 includes a pair of spaced apart mounting plates 88 which receive therebetween the transition section 84 on a pivot pin assembly 90 permitting limited movement of the transition section 84 and therefore the upper housing 82 to permit adjustment of the launch angle from zero to about 25°. The pivot pin assembly 90 may be tightened to lock the upper housing 82 and transition section 84 at a preselected launch angle. The upper housing 82 includes a molded grip handle 92 to control the launch angle when the pivot pin assembly 90 is loosened. Additionally, the upper housing 82 includes a molded drive motor case 94.

There are two openings in the upper housing 82. The first is a circular input opening 96 having a diameter at least equal to and preferably slightly larger than the diameter of the flying disc 98 to be discharged from the launcher 80. The second is a rectangular discharge opening 100 having a width at least equal to and preferably slightly larger than the diameter of the flying disc 98 and having a height at least equal to and preferably slightly larger than the height of the flying disc 98.

Figure 18:
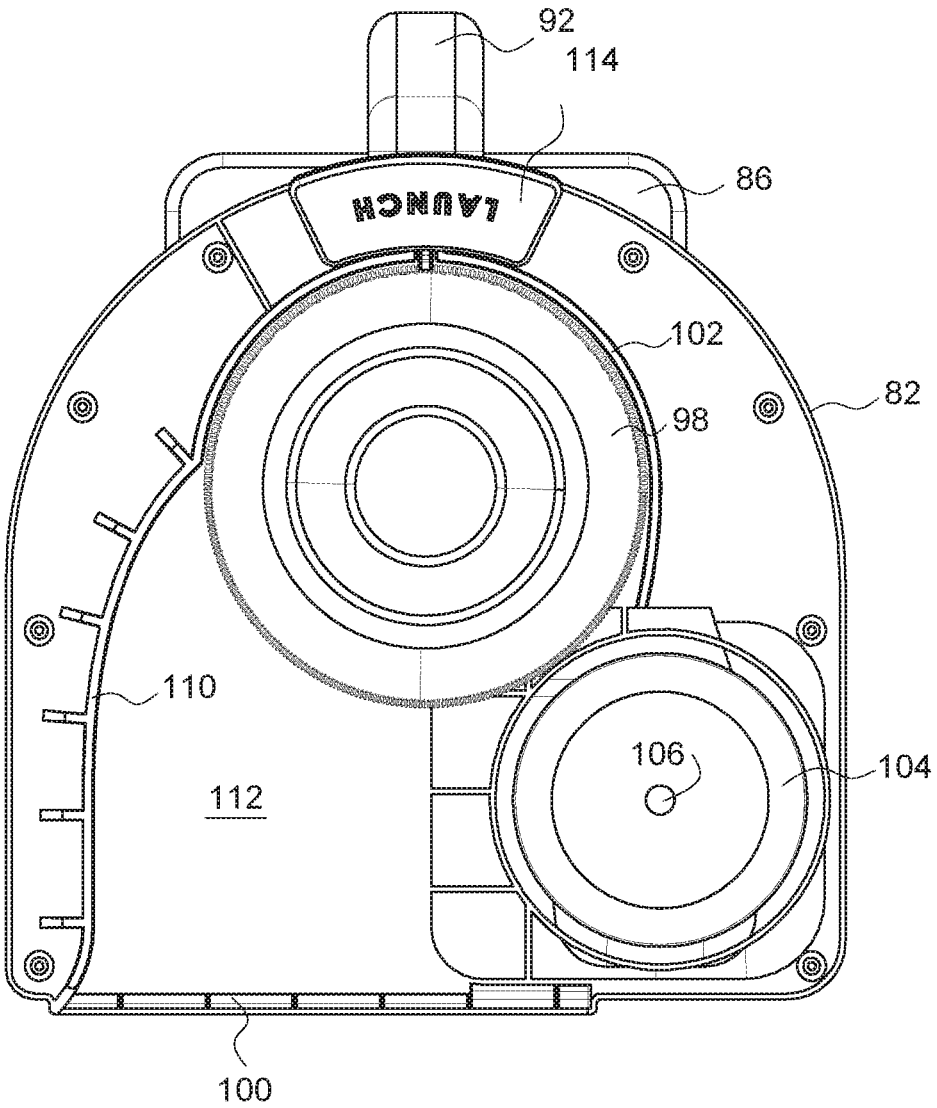
FIG. 18 is a top plan view of the flying disc launcher like FIG. 17 but with the upper housing cover removed to better illustrate the relationship between the flying disc, the spinning drive wheel and the curvilinear discharge chute.
Figure 19:
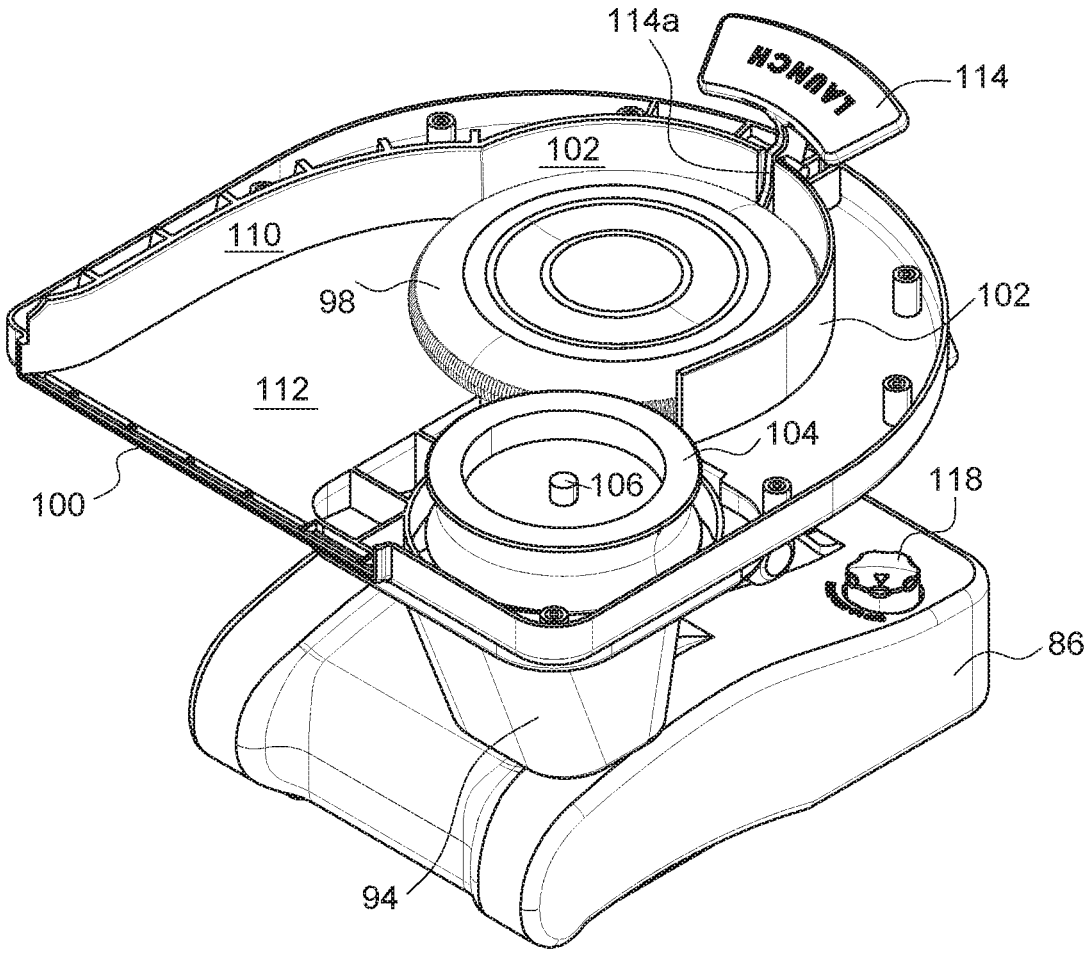
FIG. 19 is a front perspective view of the flying disc launcher like in FIG. 18 with the upper housing cover removed.
Figure 20:
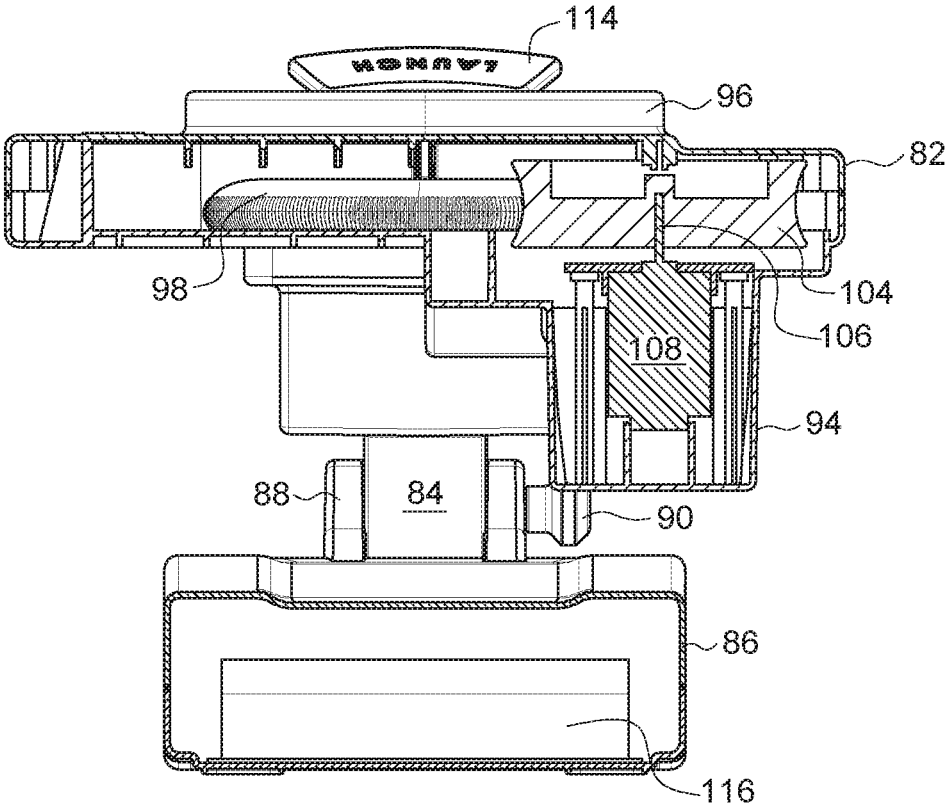
FIG. 20 is a front sectional view of the flying disc launcher.
Figure 21:
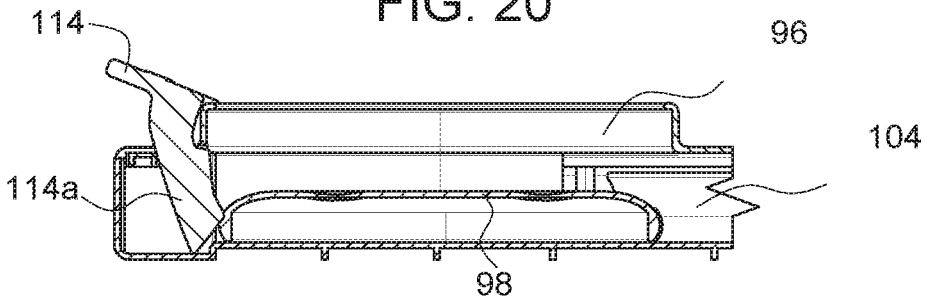
FIG. 21 is a side sectional fragmentary view illustrating the relationship between the flying disc, the spinning drive wheel, and the launch lever.
Figure 22:
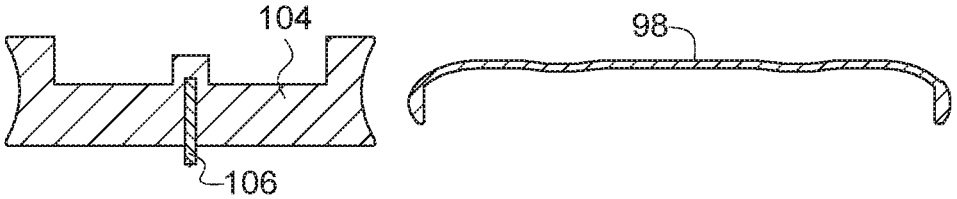
FIG. 22 is a sectional illustration of the relationship between the peripheral lip of the flying disc and the concave drive surface of the spinning drive wheel.

Interiorly of the upper housing 82 is a substantially semicircular wall 102 registering with and below the circular input opening 96 to capture a flying disc 98 therein in a pre-launch position. Offset and ahead of the pre-launch position is a drive wheel 104 centrally keyed to the work shaft 106 of the motor 108 contained in the motor case 94. The drive wheel 104 is adapted to spin in a counterclockwise rotation as shown in FIGS. 18-20. Opposite the drive wheel 104 is a curvilinear wall 110 which is concentric in radius to the axis of the drive wheel 104. The distance between the curvilinear wall 110 and the drive wheel 104 on the lower surface of the housing 82 establishes an annulus discharge chute 112 substantially equal to or slightly less than the diameter of the flying disc 98 to be discharged from the launcher 80.

The upper housing 82 includes, above the grip handle 92, a pivotally pinned launch lever 114 oriented at the rear of the pre-launch position as shown in FIG. 18. When the launch lever 114 is depressed, a lower projection 114*a* on the lever 114 engages the flying disk 98 and moves it forward to simultaneously contact the drive wheel 104 and the curvilinear wall 110. When this occurs, the drive wheel 104 will cause the flying disc 98 to rotate through the annulus discharge chute 112 in a clockwise rotation until it leaves the launcher 80 through the discharge opening 100. Importantly, the annulus discharge chute 112 extends through an angle θ around the center of the drive wheel 104 in the range of 45 to 80 degrees. For this second embodiment of the invention, however, the angle θ is preferably in the range of 45 to 60 degrees, with the angle θ for FIG. 18 being approximately 45 degrees.

Figure 17:
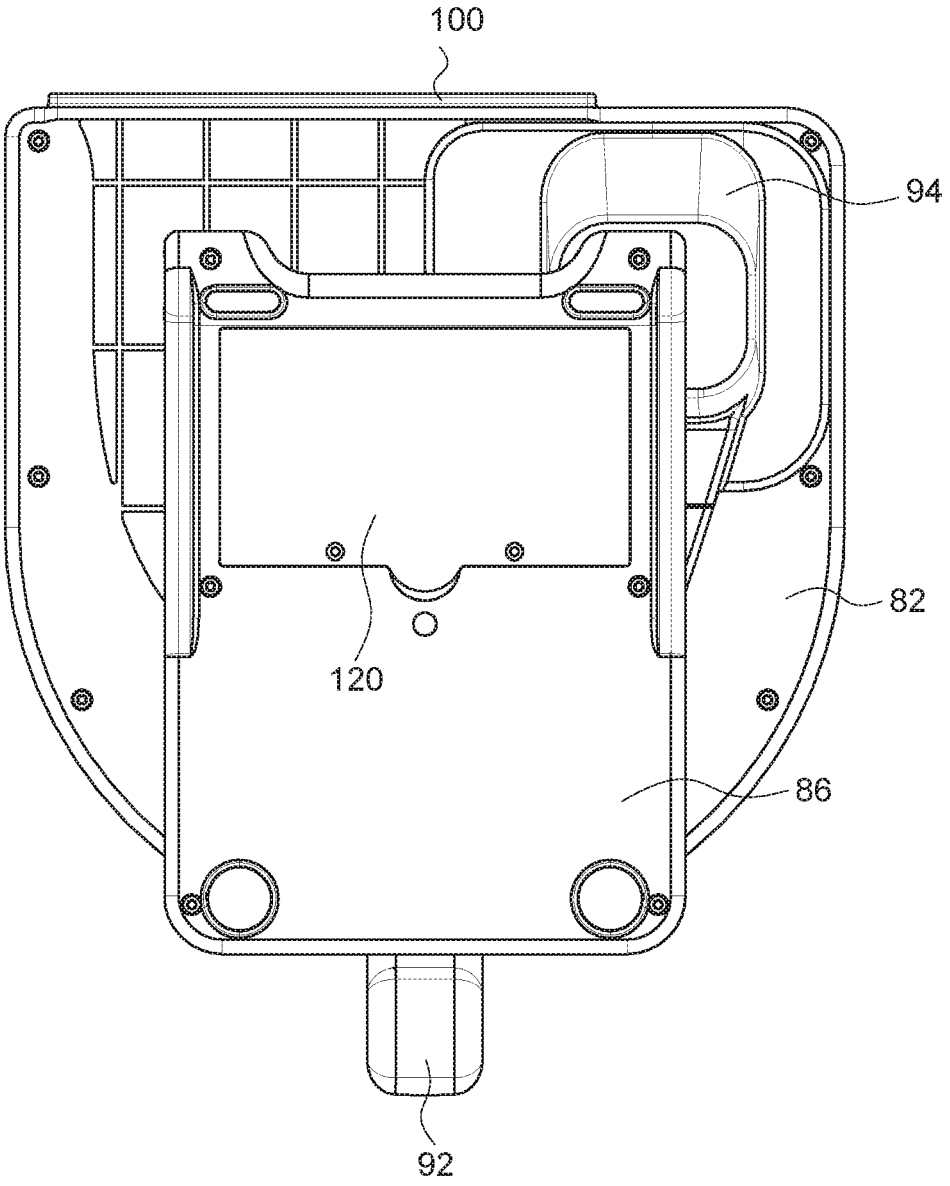
FIG. 17 is a bottom plan view of the flying disc launcher.

The base 86 includes a power source 116 operatively connected to the variable speed motor 108 with a variable motor speed control knob 118 mounted on the base 86 to turn the motor 108 on or off, and to regulate the speed thereof. The power source may alternatively include disposable DC batteries for a DC motor, rechargeable DC batteries for a DC motor, an AC power connection for an AC motor, or an AC power connection with DC inverter for a DC motor. It is thought that such power alternatives are well-known to those skilled in the arts of powering small motors. As shown in FIG. 17, the base 86 also includes an access door 120 on the bottom of the base 86 to access the power source 116 if necessary.

Applying the previously listed physics formulas to the second embodiment of the invention, if the flying disc 98 has a diameter of approximately 15.2 cm and weight of approximately 60 gm, then its moment of inertia is approximately 1733 gm-cm$^2$. Assuming the drive wheel 104 has a diameter of 9.7 cm and rotates between 3700 and 8500 rpm, and ignoring any friction loss between the drive wheel 104 and the flying disc 98 as it travels through the angle θ of about 45° in the discharge chute 112, then the theoretical angular momentum of the flying disc 98 would fall in the desirable range of 0.043 to 0.098 kg-m$^2$/sec when discharged from the launcher 80. It is preferable that the angular momentum of the smaller flying disc 98 be greater than 0.08 kg-m$^2$/sec which requires that the speed of the drive wheel 104 be towards the upper range previously indicated.

In operation of the second embodiment of the invention as previously described with reference to FIGS. 10-22, the motor 108 is turned on with switch 118 and adjusted to a desired speed for the drive wheel 104. The flying disc 98 may then be inserted into the housing 82 through the circular input opening 96 to be positioned within the semicircular wall 102 in the prelaunch position. Depressing the launch lever 114 will then cause the flying disc 98 to engage the spinning drive wheel 104, the flying disc 98 is caused to rotate clockwise against the curvilinear 110 as it travels through angle θ of approximately 45° of the annulus discharge chute 112 and is discharged from the launcher 80 at an angular momentum in the range of 0.043 to 0.098 kg-m2/sec.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS

First Embodiment wheel-driven flying disc launcher 30
housing 32
  base plate 34
  side walls 36 & 38
  top cover 40
  handle 42
forward sockets 44 & 46
rearmost socket 48
telescopic legs 50 & 52
telescopic leg 54
  upper segment 54*a*
  holes 54*b*
  push-pin 54*c*
  lower segment 54*d*
variable speed motor & housing 56
power source & housing 58
  on-off switch 58*a*
  speed control knob 58*b*
  rechargeable battery connection 58*c*
leg retention brackets 60 & 62
screws 64
bearing 66
work shaft 68
drive wheel 70
annulus discharge chute 72
flying disc 74

Second Embodiment flying disc launcher 80
upper housing 82
transition section 84
base 86
mounting plates 88
pivot pin assembly 90
molded grip handle 92
drive motor case 94
circular input opening 96
flying disc 98
rectangular discharge opening 100
semicircular wall 102
drive wheel 104
work shaft 106
motor 108
curvilinear wall 110
annulus discharge chute 112
launch lever 114
  lower projection 114*a*
power source 116
variable motor speed control knob 118
access door 120

Having thus described my invention, I claim:

1. A wheel-driven flying disc launcher for flying discs having a uniform diameter $D_1$ within a range and weight $W_1$ within a range, said launcher comprising:
- a housing having a base plate;
- a circular drive wheel having a center and a uniform diameter $D_2$ within a range operatively mounted on said base plate;
- a motor connected to said drive wheel to rotate said drive wheel on said base plate;
- a power source operatively connected to said motor;
- a curvilinear wall concentric with said circular drive wheel attached to said base plate, said curvilinear wall being spaced apart from said drive wheel a distance substantially equal to $D_1$; and
- an annulus discharge chute within a range formed between said curvilinear wall and said drive wheel and extending through an angle θ around the center of said drive wheel in the range of 45 to 80 degrees, said annulus discharge chute having an input for receiving a flying disc on said base plate and a discharge port for launching a flying disc from said base plate;
- whereby said drive wheel and said curvilinear wall impart optimal velocity, lift and angular momentum for sustained flight to a flying disc passing through said annulus discharge chute.

2. The flying disc launcher as in claim 1, said annulus discharge chute having an inside radius equal to $D_2/2$ and an outside radius substantially equal to or slightly less than $D_1+D_2/2$.

3. The flying disc launcher as in claim 2, wherein said angle θ falls in the range of 70 to 80 degrees.

4. The flying disc launcher as in claim 2, wherein $D_1$ falls in the range of 15 to 28 cm, $D_2$ falls in the range of 10 to 25 cm and $W_1$ falls in the range of 60 to 120 gm.

5. The flying disc launcher as in claim 4, wherein $D_1$ falls in the range of 20 to 28 cm, $D_2$ falls in the range of 20 to 25 cm and $W_1$ falls in the range of 100 to 120 gm.

6. The flying disc launcher as in claim 1, including an adjustable base support connected to said base plate to vary an angle of inclination of said base plate within a range relative to horizontal, said angle of inclination of said base plate within the range of 0 to 25 degrees.

7. The flying disc launcher as in claim 6, said angle of inclination of said base plate within the range of 0 to 15 degrees.

8. The flying disc launcher as in claim 6, said adjustable base support comprising tripod legs wherein one said leg being adjustable in length to preselected positions to vary the angle of inclination of said base plate.

9. The flying disc launcher as in claim 8, wherein said tripod legs being collapsible in length to approximately half their fully extended length, and adapted when collapsed to be stored on said launcher.

10. The flying disc launcher as in claim 6, said adjustable base support comprising a base connected to said housing of said base plate for limited pivotal movement, and said power source stored within said base.

11. The flying disc launcher as in claim 1, said drive wheel being driven by said motor at a sufficient rotational speed to impart an angular momentum within a range to said flying disc, said angular momentum falling in the range of 0.04 to 0.30 kg-$m^2$/sec.

12. The flying disc launcher as in claim 11, said drive wheel being driven by said motor at a sufficient rotational speed to impart an angular momentum to said flying disc falling in the range of 0.04 to 0.10 kg-$m^2$/sec.

13. The flying disc launcher as in claim 11, said drive wheel being driven by said motor at a sufficient rotational speed to impart an angular momentum to said flying disc greater than 0.20 kg-$m^2$/sec.

14. The flying disc launcher as in claim 1, said power source being disposable DC batteries for a DC motor.

15. The flying disc launcher as in claim 1, said power source being rechargeable DC batteries for a DC motor.

16. The flying disc launcher as in claim 1, said power source being an AC power connection for an AC motor.

17. The flying disc launcher as in claim 1, said power source being an AC power connection with DC inverter for a DC motor.

* * * * *